US011248344B2

(12) United States Patent
Mambrim Filho et al.

(10) Patent No.: US 11,248,344 B2
(45) Date of Patent: Feb. 15, 2022

(54) METHOD FOR PRODUCING CELLULOSE PULP, CELLULOSE PULP AND USE THEREOF, PAPER

(71) Applicant: Suzano S.A., São Paulo (BR)

(72) Inventors: Otávio Mambrim Filho, Aracruz (BR); Leonardo Alves De Melo, São José dos Campos (BR)

(73) Assignee: Suzano S.A., São Paulo (BR)

( * ) Notice: Subject to any disclaimer, the term of this patent is extended or adjusted under 35 U.S.C. 154(b) by 232 days.

(21) Appl. No.: 16/067,234

(22) PCT Filed: Dec. 27, 2016

(86) PCT No.: PCT/BR2016/050355

§ 371 (c)(1),
(2) Date: Nov. 6, 2018

(87) PCT Pub. No.: WO2017/112995

PCT Pub. Date: Jul. 6, 2017

(65) Prior Publication Data

US 2019/0062999 A1 Feb. 28, 2019

(30) Foreign Application Priority Data

Dec. 29, 2015 (BR) ..... 102015032911-3

(51) Int. Cl.
*D21H 11/20* (2006.01)
*D21H 17/00* (2006.01)
(Continued)

(52) U.S. Cl.
CPC ..... *D21H 11/20* (2013.01); *D21C 3/02* (2013.01); *D21C 5/00* (2013.01); *D21C 9/10* (2013.01); *D21C 9/12* (2013.01); *D21C 9/123* (2013.01); *D21C 9/18* (2013.01); *D21H 11/04* (2013.01); *D21H 11/12* (2013.01);
(Continued)

(58) Field of Classification Search
CPC ..... D21H 17/005; D21H 17/28; D21H 17/29
See application file for complete search history.

(56) References Cited

U.S. PATENT DOCUMENTS 5,169,497 A 12/1992 Sarkar et al.
5,423,946 A 6/1995 Sarkar et al.
(Continued)

FOREIGN PATENT DOCUMENTS

WO WO 00/068500 A1 11/2000
WO WO 2003/021033 3/2003
WO WO 06/049542 A1 5/2006

OTHER PUBLICATIONS

Hubbe et al., Advanced in Papermaking Wet End Chemistry, 2018, TAPPI Press, p. 270-274 (Year: 2018).*
(Continued)

*Primary Examiner* — Anthony Calandra
(74) *Attorney, Agent, or Firm* — Alston & Bird LLP

(57) ABSTRACT

The present invention relates to an enhanced process for the production of cellulose pulps with increased quality and applicability of said pulps, especially their physical resistance properties and degree of resistance to drainage, through an enzymatic treatment step comprised in the production process of said cellulose pulp, concomitantly with the polymer dosage based on carbohydrates.

11 Claims, 5 Drawing Sheets

(51) Int. Cl.

| | |
|---|---|
| ***D21H 17/28*** | (2006.01) |
| ***D21H 23/04*** | (2006.01) |
| ***D21C 3/02*** | (2006.01) |
| ***D21H 11/04*** | (2006.01) |
| ***D21H 21/10*** | (2006.01) |
| ***D21C 9/10*** | (2006.01) |
| ***D21H 21/18*** | (2006.01) |
| ***D21H 17/21*** | (2006.01) |
| ***D21C 9/12*** | (2006.01) |
| ***D21C 5/00*** | (2006.01) |
| ***D21C 9/18*** | (2006.01) |
| ***D21H 11/12*** | (2006.01) |

(52) U.S. Cl.

CPC ..... *D21H 17/005* (2013.01); *D21H 17/21* (2013.01); *D21H 17/28* (2013.01); *D21H 21/10* (2013.01); *D21H 21/18* (2013.01); *D21H 23/04* (2013.01)

(56) References Cited

U.S. PATENT DOCUMENTS

| | | | | |
|---|---|---|---|---|
| 5,501,770 | A | 3/1996 | Sarkar et al. | |
| 5,507,914 | A | 4/1996 | Sarkar et al. | |
| 6,939,437 | B1 | 9/2005 | Hill, Jr. et al. | |
| 2002/0100568 | A1 | 8/2002 | Covarrubias | |
| 2011/0168344 | A1* | 7/2011 | Klein | D21H 21/10 162/164.6 |
| 2013/0139980 | A1* | 6/2013 | Ban | D21H 17/20 162/74 |
| 2013/0146239 | A1* | 6/2013 | Tausche | D21H 11/14 162/72 |
| 2015/0107789 | A1* | 4/2015 | Ni | D21C 3/02 162/55 |

OTHER PUBLICATIONS

Smook, Handbook for Pulp and Paper Technologists, 1992, Angus Wilde Publications, 2nd edition, chapters 13 and 15. (Year: 1992).*

Gonzalez, I et al., "Effect of the Combination of Biobeating and NFC on the Physico-Mechanical Properties of Paper" Cellulose, dated Apr. 2013, pp. 1-12.

Pommier, J et al., "Using Enzymes to Improve the Process and the Product Quality in the Recycled Paper Industry" Tappi Journal, dated Jun. 1989, pp. 187-191.

International Search Report and Written Opinion for International Application No. PCT/BR2016/050355 dated Jun. 2, 2017, 11 pages.

Moram, B.R., "Enzyme Treatment Improves Refining Efficiency, Recycled Fiber Freeness" Pulp & Paper, vol. 70, No. 9, dated Sep. 1996, pp. 119-121.

Reid, R., "Pectinase in Papermaking: Solving Retention Problem in Mechanical Pulp Bleached with Hydrogen Peroxide", Enzyme and Microbial Technology, vol. 26, dated (2000), pp. 115-123.

Sarkar, J.M. et al., Applying Enzymes and Polymers to Enhance the Freeness of Recycled Fiber. Tappi Journal (USA), V.78, No. 2, dated Feb. 1995, pp. 89-95.

* cited by examiner

METHOD FOR PRODUCING CELLULOSE PULP, CELLULOSE PULP AND USE THEREOF, PAPER

FIELD OF THE INVENTION

The present invention relates to an improved process for the production of cellulose pulps with increased quality and applicability of said pulps, especially their physical resistance properties and degree of resistance to drainage, through an enzymatic treatment step comprised in the production process of said cellulose pulp, concomitantly with the polymer dosage based on carbohydrates.

BACKGROUND OF THE INVENTION

The quality and final characteristics of a paper are directly associated with the type of cellulose fiber used in its composition. In recent years, several studies have been carried out to relate the impact of changes in the characteristics of cellulose fibers on the physical-mechanical properties of paper. Among these characteristics of the cellulose fibers, their flexibility and their number of carboxylic groups are considered important for the development of paper with physical resistance, without compromising its structure.

Besides the concern with fiber quality and the improvement of its characteristics, the paper and pulp industry faces constant challenges to solve the problems related to the high consumption of industrial water in its processes, which results in high energy consumption.

The enzymatic treatments described in the prior art were introduced in the cellulose fiber production process as a solution to promote the reduction of the consumption of the chemicals employed in the process through their action, and with that, also to improve the characteristics of the effluent generated by the process. Another result of the enzymes dosage in the process is the reduction of energy expenditure.

As for the physical strength properties of cellulose fibers, it can be stated that they are related to the amount of carboxylic groups present and to the flexibility of the fibers.

The greater the amount of carboxylic groups present in the fibers, and the more flexible these fibers, the greater physical strength, that is, traction will be imparted to the paper produced therefrom.

This is due to the increase in the area of contact between the fibers with these characteristics, which then enables a growth in the number of bonds between said fibers. In addition, the increase of carboxylic groups or ligands allows the formation of greater number of hydrogen bonds.

Some prior art documents also mention the differentiation of the physical properties of fibers and paper by the application of enzymes in the production process. However, according to the already described in the state of the art, increasing the physical strength of the pulp, via the use of enzymes, often compromises its drainage. Or even, when there is an improvement in the drainage capacity of the fiber, there is a worsening in its physical resistance.

Document WO2003/021033 describes a process for producing tissue paper in a machine, where the paper product contains cellulose fibers. An enzymatic treatment is carried out on the cellulose fibers in order to increase the number of reactive aldehyde groups on the surface of said fibers. The treatment disclosed in said document consists of mixing an aqueous suspension of cellulose fibers with one or more hydrolytic enzymes, optionally in the presence of surfactants, other non-cellulase/hemicellulase enzymes or non-hydrolytic chemical reagents wherein the aldehyde groups are formed in the the surface of the fibers or in their proximity. The use of these hydrolytic enzymes, in particular cellulases, is responsible for the degradation of the fibrous cell wall, impairing the tensile properties of the paper.

Gonzales et al. (2013) describes a process of pulp enzymatic treatment combined with the addition of nanofibrillated celluloses (NFC) which results in the improvement of the physical and mechanical properties of a pulp suspension used in papermaking. However, the results of the study showed that there was no increase in fiber drainage.

Pommier et al. (1989) describes the enzymatic action on cellulose pulp as a "peeling effect" and suggests that the enzymes defibrillate the cellulose fibers by removing molecules with high affinity for water, but with a small contribution to the overall hydrogen bonding potential of the fibers. This reduction in pulp-water interactions allows a greater drainage of the pulp. However, it leads to a reduction in the strength and length of the fiber, in addition to an excessive production of fines. As a consequence, paper strength is dramatically affected.

While performing an enzymatic treatment step in the cellulose refining process is known from the prior art, it is imperative to develop a process in which the application of the enzyme results in an increase in the surface area of the cellulose fiber without compromising the physical properties of the treated fiber, and in which the obtained cellulose pulp exhibits greater physical—traction and tear—resistance and at least the maintenance of its degree of resistance to drainage.

SUMMARY OF THE INVENTION

The present invention aims to provide cellulose pulps with improved surface properties, these properties being also observed on paper produced from said cellulose pulp.

A first embodiment of the present invention relates to a process for producing cellulose pulp from cellulosic feedstock by dosing enzymes at certain concentrations and process step.

A second embodiment of the invention relates to the cellulose pulp produced from said process, said pulp having a tensile index ranging from 27.2 to 52.2 Nm/g, preferably from 27.5 to 34.0 Nm/g, and a tear index between 4.0 and 8.0 $Nm^2/kg$, preferably between 4.5 and 6.5 $Nm^2/kg$, and further said pulp produced by said process maintains the degree of drain resistance.

A third embodiment of the invention relates to the use of the cellulose pulp obtained by said process to produce paper.

A fourth embodiment relates to the paper produced from the pulp obtained by said process.

DETAILED DESCRIPTION OF THE INVENTION

The present invention relates to a process for the production of cellulose pulp with increased quality and applicability of said pulps, especially their physical resistance properties, at least the maintenance of their degree of resistance to drainage, through an enzymatic treatment step, concomitantly with the dosage of a carbohydrate-based polymer comprised in the production process of said cellulose pulp.

The carbohydrate-based polymer may be selected from the group consisting of: starch, carboxymethylcellulose, guar gum, among others.

The enzymatic treatment comprises the use of enzyme or mixture of hydrolytic enzymes (EZ), known to one skilled in the art and commercially available, and which may be selected from the group consisting of: α-amilase, 2 β-amilase, glucan 1,4-α-glucosidase, cellulase, endo-1,3(4)-β-glucanase, inulinase, endo-1,4-β-xylanase, oligo-1,6-glucosidase, dextranase, chitinase, polygalacturonase, lisozime, exo-α-sialidase, α-glucosidase, β-glucosidase. α-galactosidase, β-galactosidase, α-mannosidase, β-mannosidase, β-fructofuranosidase, α,α-trehalase, β-glucuronidase, endo-1,3-β-xilanase, amilo-1,6-glucosidase, hialuronoglucosaminidase, hialuronoglucuronidase, xilan 1,4-β-xilosidase, β-D-fucosidase, glucan endo-1,3-β-D-glucosidase, α-L-rhamnosidase, pululanase, GDP-glucosidase, β-L-rhamnosidase, fucoidanase, glucosilceramidase, galactosilceramidase, galactosilgalactosilglucosilceramidase, sucrose α-glucosidase, α-N-acetilgalactosaminidase, α-N-acetilglucosaminidase.

The performance of the enzyme or enzyme mixture (EZ) available in the market occurs in the surface area of the cellulose fiber, potentiating the adsorption capacity of the fiber modifying chemicals during the pulp production process.

However, the dosage of enzymes in excessive concentrations may cause them to act more deeply in the fibers, which could significantly alter their physical resistance and their degree of resistance to drainage and even degrade the walls of said fibers fibers.

The inventors have found increased physical strength and, surprisingly, at least the maintenance of the degree of drainability of the cellulose pulp obtained by the process described herein, by defining specific enzyme levels to be dosed together with the carbohydrate-based polymer, in the step after bleaching of the pulp and before drying of said pulp.

Figure 1:
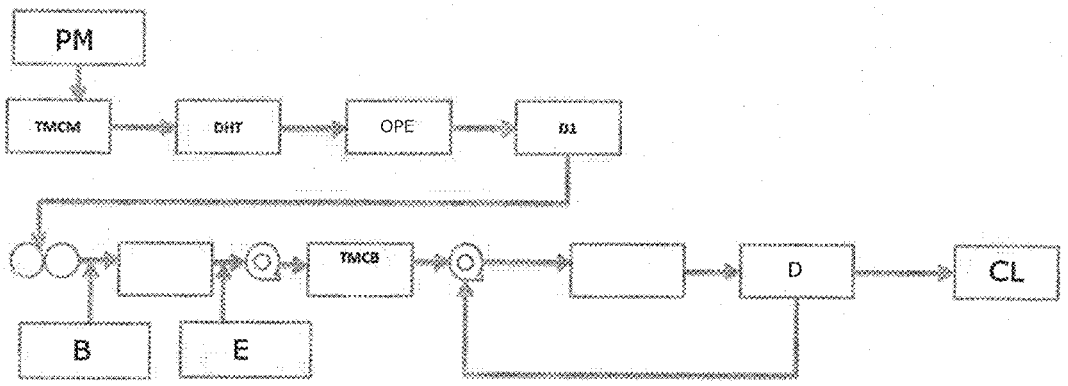
FIG. 1—shows a simplified flowchart showing the enzymatic treatment step concomitantly with carbohydrate-based polymer dosage according to a preferred embodiment of the invention.

FIG. 1 shows the steps of the process of the present invention. The process for producing the cellulose pulp comprises the steps of:

a) treating the cellulosic feedstock through the chemical or semi-chemical pulping process to produce brown cellulose pulp (BP);

b) bleaching the brown cellulose pulp through the bleaching sequence to obtain the white pulp;

c) adding the carbohydrate-based polymer (B), wherein the dosage of said polymer ranges from 2 to 12 kg/ton of cellulose pulp;

c) adding the enzyme or enzyme mixture to the white slurry pulp already doped with the carbohydrate-based polymer (B), wherein the addition of the enzyme (E) or enzyme mixture takes place according to the following conditions:

i. reaction temperature between 40 and 90° C.;

ii. reaction pH between 3.0 and 9.0 using a strong base or a strong acid for pH adjustment, controlled by means of pH measurement;

iii. reaction time between 10 and 300 minutes;

iv. enzyme amount between 10 g of EZ and 200 g of EZ per ton of cellulose;

e) conveying the doped white slurry pulp to and through the reaction tower before the drying machine (TMCB); and f) drying (S) the doped white slurry pulp to obtain the cellulose pulp (CL).

Figure 2:
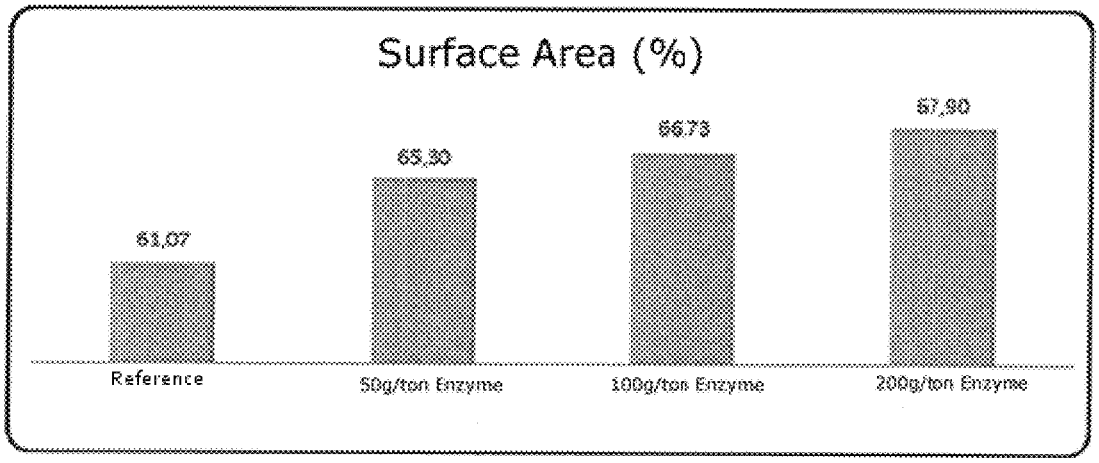
FIG. 2—shows a graph illustrating an increase in the surface area of the fiber with the enzyme dosage.

FIG. 2 shows that the dosage of 50, 100 or 200 g/ton of enzyme causes an increase in the fiber surface area when compared with a reference sample. The reference sample is a white slurry pulp that has not been doped, that is, it did not receive a dosage of the carbohydrate-based polymer and enzyme or mixture of enzymes.

The enzymatic treatment applied under controlled conditions of the kinetic variables of the reactions involved, namely temperature, pH and time, leads to a greater efficiency of the treatment and with that, an enzyme dosage more optimized for the production process of cellulose pulp.

Figure 3:
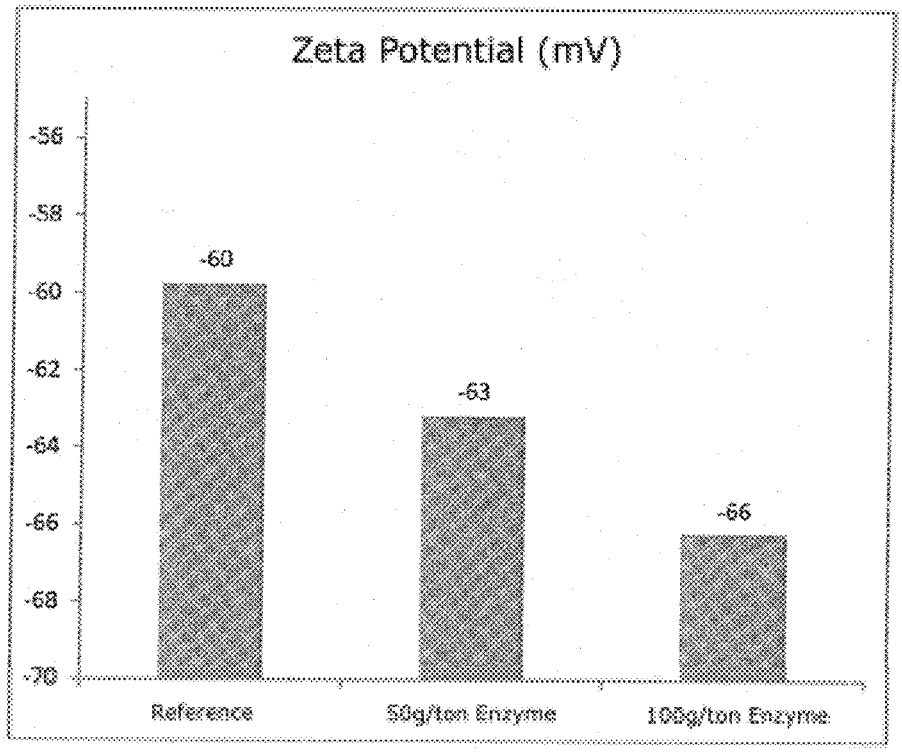
FIG. 3—shows graphs with assay data confirming that the enzymatic treatment can alter the reactivity of the fibers surface, evaluated through the zeta potential.

FIG. 3 shows the increased reactivity of the fiber produced by the process of the present invention. The reactivity is represented by the zeta potential.

Figure 4:
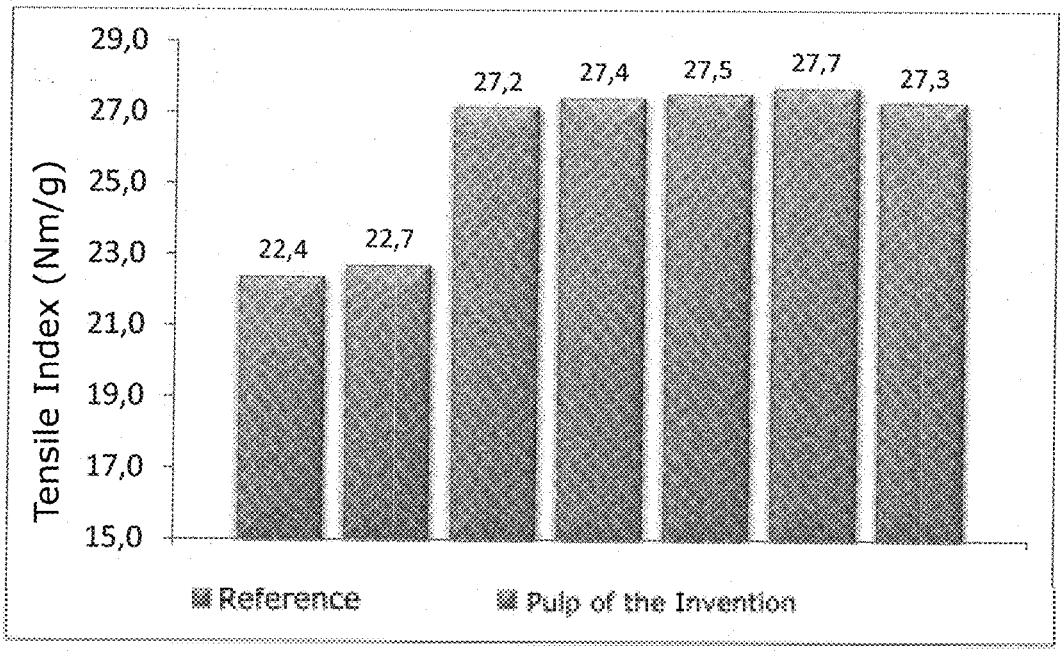
FIG. 4—shows a graph illustrating the increase in the tensile index of the pulp of the present invention compared with the reference pulp.
Figure 5:
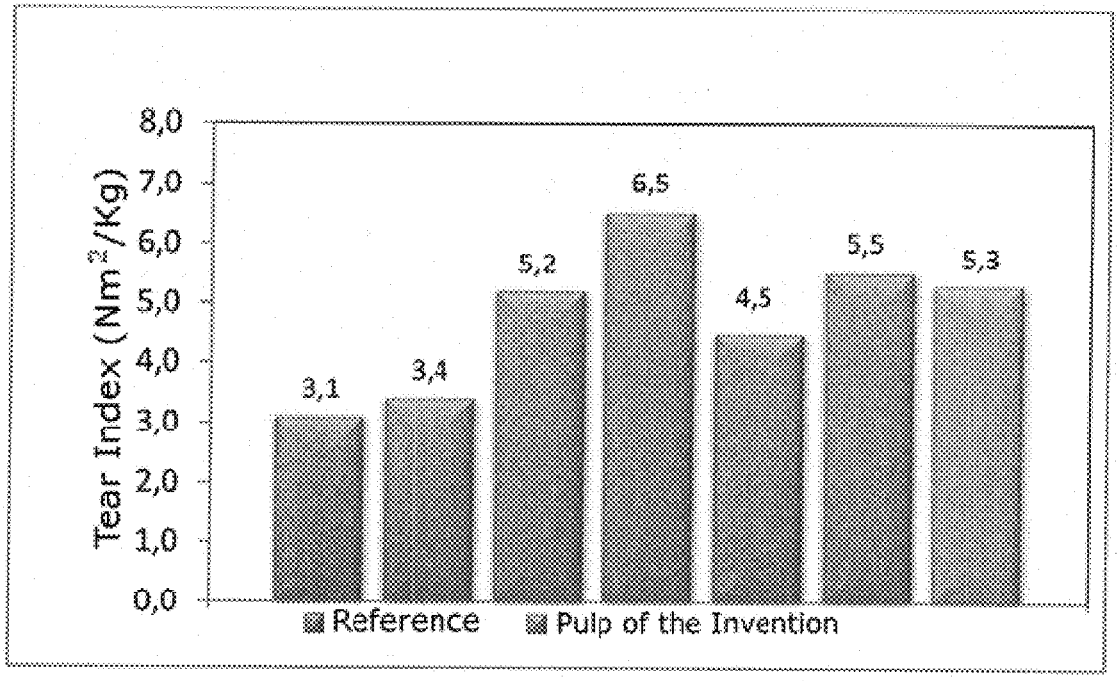
FIG. 5—shows a graph illustrating the increase in the tear index of the pulp of the present invention compared with the reference pulp.

FIGS. 4 and 5 demonstrate the physical strength gains of the pulp obtained by the process described in the present invention when compared to the reference pulp. Furthermore, FIG. 6 proves the maintenance of the degree of resistance to drainage of the pulp of the present invention in comparison with the reference pulp.

Figure 7:
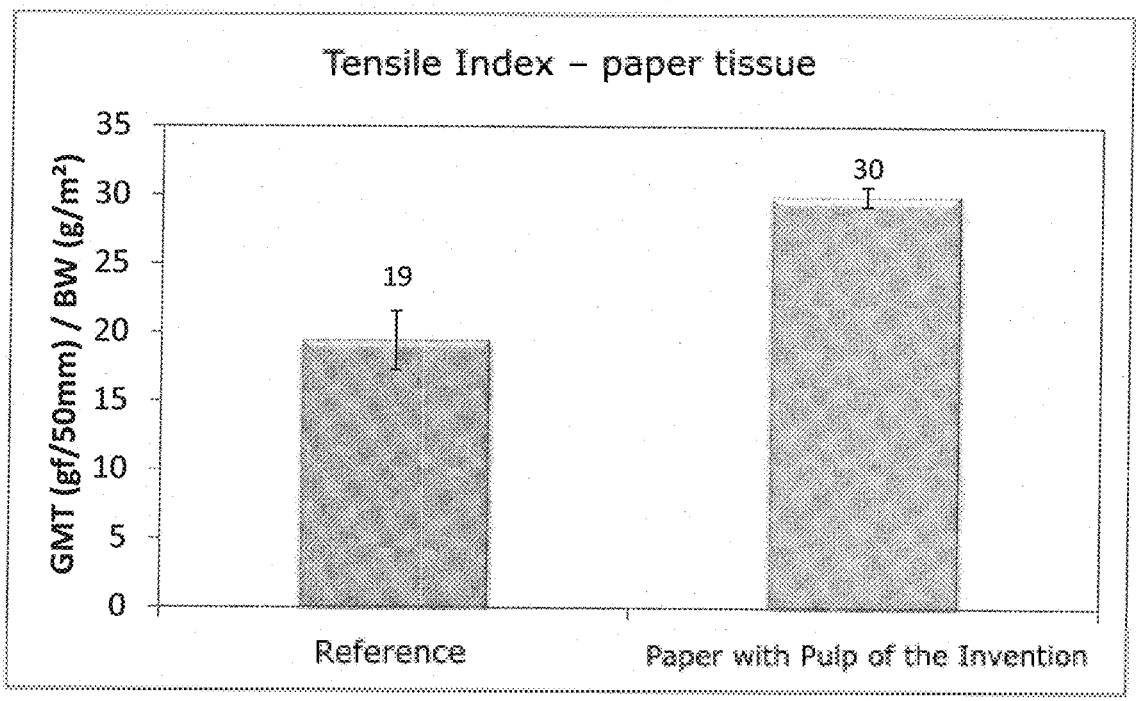
FIG. 7—shows a graph demonstrating that paper produced from the pulp of the present invention reproduces the tensile gains that the pulp of the present invention exhibits.

The paper obtained from the pulp of the present invention reproduces these gains in physical resistance as shown in FIG. 7.

Furthermore, since the dosage of the enzyme or commercial enzyme mixture takes place prior to the drying step of the white slurry pulp, said enzyme or enzyme mixture undergoes denaturation during said drying step, which results in a cellulose pulp (CL) without residues of enzyme or enzyme mixtures, as proved by the performance of the ELISA assay.

In a preferred embodiment of the present invention, the cellulose pulp production process comprises the steps of:

a) treating the cellulosic feedstock through the chemical pulping process, chemical pulping being preferably a Kraft process, to produce brown cellulose pulp (BP);

b) bleaching the brown cellulose pulp through a bleaching sequence comprising treatment with hot chlorine dioxide (DHT), followed by treatment with soda and peroxide (OPE), followed by treatment with chlorine dioxide (D1);

c) adding the carbohydrate-based polymer (B), wherein the dosage of said polymer ranges from 2 to 12 kg/ton of cellulose pulp, adding preferably between 3 and 10 Kg of polymer/ton of cellulose pulp;

d) adding the enzyme or enzyme mixture to the white slurry pulp already doped with the carbohydrate-based polymer (B), wherein the addition of the enzyme (E) or enzyme mixture takes place according to the following conditions:

i. reaction temperature between 50 and 80° C.;

ii. reaction pH between 3.5 and 8.0, using either sodium hydroxide or sulfuric acid for pH adjustment;

iii. reaction time between 30 and 120 minutes;

iv. enzyme amount between 20 g of EZ and 100 g of EZ per ton of cellulose;

e) conveying the added white slurry pulp to and through the reaction tower before the drying machine (TMCB);

and f) drying (S) the doped white slurry pulp to obtain the cellulose pulp (CL).

In another preferred embodiment of the present invention, the cellulose pulp production process can be described as:

a) treating the cellulosic feedstock through the chemical pulping process, wherein the chemical pulping is preferably a Kraft process, to produce brown cellulose pulp (BP);

b) bleaching the brown cellulose pulp through a bleaching sequence comprising treatment with hot chlorine dioxide (DHT), followed by treatment with soda and peroxide (OPE), followed by treatment with chlorine dioxide (D1);

c) adding the enzyme or enzyme mixture to the white slurry pulp and already doped with the carbohydrate-based polymer (B), wherein the addition of the enzyme (E) or enzyme mixture takes place according to the following conditions:

i. reaction temperature between 50 and 80° C.;

ii. reaction pH between 3.5 and 8.0, using either sodium hydroxide or sulfuric acid for the adjustment;

iii. reaction time between 30 and 120 minutes;

iv. enzyme amount between 20 g of EZ and 100 g of EZ per ton of cellulose;

a) adding the carbohydrate-based polymer (B), wherein the dosage of said polymer ranges from 2 to 12 kg/ton of cellulose pulp, dosing preferably between 3 and 10 kg of polymer/ton of cellulose pulp;

e) conveying the doped white slurry pulp to and through the reaction tower before the drying machine (TMCB); and f) drying (S) the doped white slurry pulp to obtain the cellulose pulp (CL).

The chemical pulping process, more specifically the Kraft pulping process, as already described in the state of the art, comprises treating the fibers of vegetable origin, including the following steps:

a) digestion—where vegetable fibers are boiled together with sodium hydroxide and sodium sulphide to separate the brown cellulose pulp (BP) from the lignin;

b) separation of the black liquor from the cellulose—the black liquor must be separated from the brown cellulose pulp (BP);

c) recovery boiler—the black liquor is treated until it can be burned in the recovery boiler to generate energy;

d) closing the circuit by recovering sodium hydroxide, sodium sulphide and water;

e) transformation of the brown cellulose pulp (BP) into bleached cellulose (CL); said transformation comprising:

i) washing the cellulose pulp with water to remove residual black liquor;

ii) pre-bleaching;

iii) bleaching;

iv) cellulose (CL) drying.

In other embodiments of the present invention, the step (b) of bleaching a brown cellulose pulp (BC) from the pulping process of the cellulose pulp of the present invention may be selected from the group consisting of:

1) treatment with hot dioxide (DOHOT), followed by oxidative peroxide extraction (OPE), followed by final treatment with dioxide (D)—elemental chlorine-free product (ECF);

2) acidification stage with sulfuric or hydrochloric acid (A), DO (not-hot dioxide treatment), followed by oxidative peroxide extraction (OPE), followed by another dioxide treatment (D1), followed by peroxide extraction (pE), followed by another dioxide treatment (D2)—elemental chlorine-free product (ECF);

3) hot dioxide treatment (HOTDo), followed by oxidative peroxide extraction (OPE), followed by treatment with dioxide with soda neutralization, and another dioxide treatment stage (DnD)—elemental chlorine-free product (ECF);

4) a stage of delignification (0) followed by the conveyance of pulp to and into an acid tower, washing, use of ozone with extraction (AZe), followed by another washing, then dioxide treatment (d) and addition of peroxide (P)—element chlorine-free product (ECF);

5) a delignification stage (0), followed by acidification (aZe) for 15 minutes, followed by ozone application, followed by extraction, then washing with water, dioxide treatment (D), washing again, peroxide addition (P), followed by washing, and finally drying—elemental chlorine-free product (ECF);

6) a delignification stage (0), followed by an acidification stage with sulfuric or hydrochloric acid (A) followed by ozone extraction (Ze), followed by peroxide addition (P) followed by a further peroxide addition (P)—elemental chlorine-free product and chlorine-based compounds (TCF);

7) a delignification stage (0), using ozone extraction (aZe), followed by peroxide addition (P) followed by a further peroxide addition (P)—elemental chlorine-free product and chlorine-based compounds (TCF);

8) delignification (00) with oxygen to lower the Kappa number by 35%, acidification stage with sulfuric or hydrochloric acid, and hot dioxide treatment (HOTDo), followed by oxidative peroxide extraction (OPE), followed by dioxide treatment (D), and final peroxide addition (P)—elemental chlorine-free product (ECF).

In the last bleaching stage, the carbohydrate-based polymer and commercial enzyme or enzyme mixture are dosed, which are then conveyed to and through a homogenization device, which ensures the greatest contact between the products dosed and the fiber. Then, this mixture is transferred to a mixing pump where effective mixing of the additives takes places. Thereafter, the carbohydrate-based polymer-doped pulp and commercial enzyme or enzyme mixture is pumped into a reaction tower, where the mixture remains for 10 to 300 minutes, preferably for 30 to 120 minutes, at a temperature between 40 and 90° C., preferably between 50 and 80° C., and pH ranging from 3.0 to 9.0, preferably ranging from 3.5 to 8.0, using sodium hydroxide or sulfuric acid for pH adjustment, in order to complete the reaction.

The obtained pulp is then diluted and pumped into the drying step. Then, the cellulose pulp (CL) is obtained for the paper market.

Figure 6:
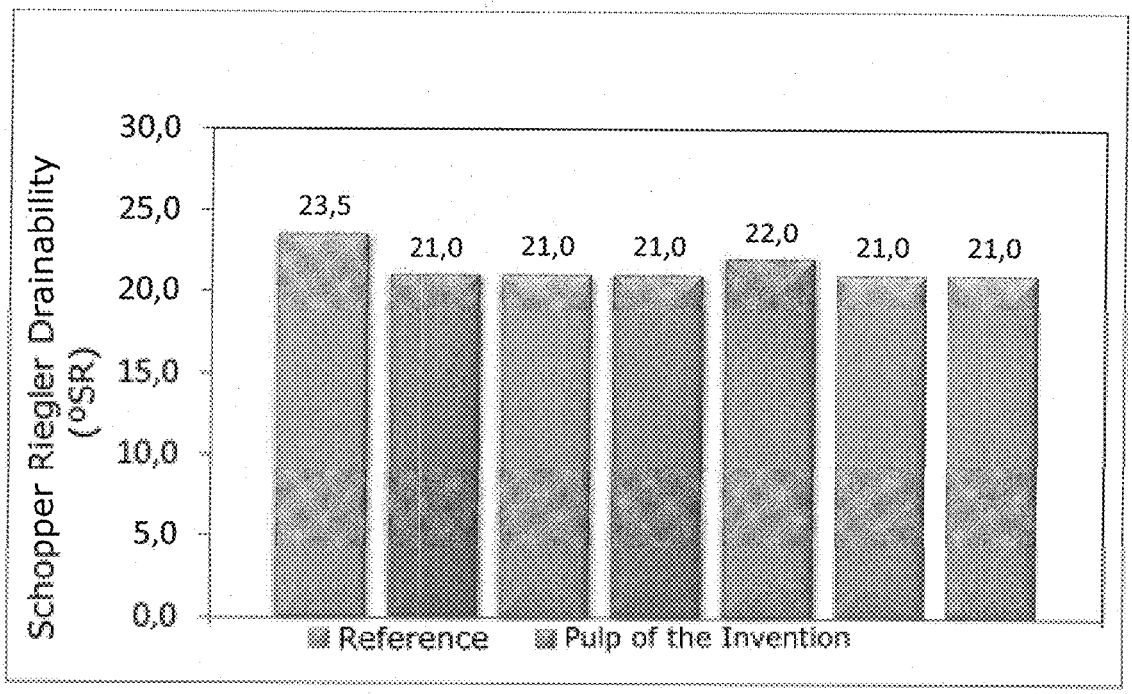
FIG. 6—shows a graph illustrating a comparison between the degree of drainability of the pulp of the present invention and that of the reference pulp.

The inventors have further found that, contrary to the teachings of the state of the art, the process described herein results in a cellulose pulp (CL) with higher physical strength, that is, to tear and traction, and also with at least the maintenance degree of resistance to drainage, as shown in FIGS. 4 to 6.

According to a preferred embodiment of the present invention, the enzymatic treatment is carried out by the action of hydrolytic enzymes, for example, cellulases, or mixture of cellulases with other enzymes available on the market with fillers ranging from 20 to 100 grams of enzyme per ton of cellulose.

Said enzymatic treatment (E) is conducted in a step subsequent to the bleaching process of the pulp obtained by the chemical pulping process, and prior to the drying step (D) of the pulp so that it is then used in papermaking.

Preferably, the enzymatic treatment has a retention time in the range of 30 to 120 minutes, a pH in the range of 3.5 to 8.0, a temperature in the range of 50 to 80° C., preferably when the hydrolytic enzyme is a cellulase.

The fibers used in the process of the present invention may be so-called vegetable fibers, preferably short fibers, more preferably *eucalyptus* fibers.

The cellulose pulp of the present invention, obtained by a process including an enzymatic treatment step, concurrently dosing a carbohydrate-based polymer, surprisingly presents an increased surface area of the cellulose fiber without compromising the physical properties of the treated fiber, and also ensuring that the obtained cellulose pulp exhibits greater physical resistance—to traction and tear—and at least maintain its degree of resistance to drainage.

EXAMPLES

The following examples will better illustrate the present invention and the particular conditions and parameters described represent preferred but not limiting embodiments of the present invention.

Example 1: Polymer Production Process—Addition of Polymer Followed by Enzyme Addition For a Kraft pulping process, the carbohydrate-based polymer, but specifically starch, was used in a dosage of 3 to 10 kg/ton of cellulose pulp from short fibers. Thereafter, 30 to 50 g of EZ per ton of cellulose were added, wherein the reaction conditions are as follows: temperature from 50 to 90° C., pH 3.0 to 8.0, over a period from 60 to 240 minutes. The used bleaching sequence was an ECF sequence.

Example 2: Polymer Production Process—Addition of Enzyme Followed by Polymer Addition For a Kraft pulping process, 30 to 50 g of EZ per ton of cellulose were added from short fibers, wherein the reaction conditions are as follows: temperature from 50 to 90° C., pH 3.0 to 9.0, over a period from 60 to 240 minutes. Thereafter, a carbohydrate-based polymer, but specifically starch, was dosed at a dosage of 3 to 10 kg/tonne of cellulose pulp. The used bleaching sequence was an ECF sequence.

Example 3: Description of the Comparative Tests with the References

Comparative tests for evaluating the characteristics of the cellulose pulp obtained from the process of the present invention were carried out with the concomitant addition of carbohydrate-based polymer and commercially available enzyme or enzyme mixture.

In the laboratory tests, the equipment used was a cellulose bleach reactor with a capacity of 300 g of dry fibers and total automatic control of the process conditions, which were adjusted to: temperature of 50° C., pH of 7.0 and reaction time of 120 minutes. The amount of enzyme or enzyme mixture used ranged from 0 (Reference) to 50 to 200 g/tsa (Samples A, B, C and D).

The results of the laboratory tests are described in Table 1.

TABLE 1

| Sample | Enzyme amount | Tear Index ($Nm^2/kg$) | Tensile Index (Nm/g) |
|---|---|---|---|
| Reference | 0 | 5.9 | 34.9 |
| Sample A | 50 g/tsa | 7.7 | 52.2 |
| Sample B | 100 g/tsa | 7.0 | 53.2 |
| Sample C | 150 g/tsa | 6.3 | 55.8 |
| Sample D | 200 g/tsa | 5.7 | 55.1 |

As can be evidenced by the above results, there was an improvement in the rates of tear and traction of the obtained pulp.

The comparative tests were followed by tests on larger scale, when the reactor having a dry pulp capacity of 100 kg and having automatic control of the process variables was used. The variables were maintained: temperature of 50° C., pH of 7.0 and reaction time of 120 minutes. The amount of enzyme or enzyme mixture used was 50 g/t.

Again, it was possible to verify that, in comparison to the reference, the pulp of the present invention showed improved physical strength without compromising its degree of resistance to drainage. The results are described in Table 2.

TABLE 2

| Sample | Drainability (° SR) | Tear Index ($Nm^2/kg$) | Tensile Index (Nm/g) |
|---|---|---|---|
| Reference | 17.5 | 3.8 | 23.2 |
| Sample 50 g/tsa | 20.0 | 5.8 | 30.6 |

Also, tests on an even larger scale were carried out, and also demonstrated the improvement in the physical resistance of the obtained pulp, maintaining the degree of resistance to drainage. The amount of enzyme or mixture of enzymes used was 30 g/tsa and 50 g/t.

The results are shown in table 3 below.

TABLE 3

| Sample | Drainability (° SR) | Tear Index ($Nm^2/kg$) | Tensile Index (Nm/g) |
|---|---|---|---|
| Reference A | 23.5 | 3.1 | 22.4 |
| Reference B | 21.0 | 3.4 | 22.7 |
| Batch 1 | 21.0 | 5.2 | 27.2 |
| Batch 2 | 21.0 | 6.5 | 27.4 |
| Batch 3 | 22.0 | 4.5 | 27.5 |
| Batch 4 | 21.0 | 5.5 | 27.7 |
| Batch 5 | 21.0 | 5.3 | 27.3 |

The data are graphically represented in FIGS. 4, 5 and 6.

The reproducibility of the improved physical strength characteristics of the pulp of the present invention has therefore been observed from the laboratory scale to larger scales.

Example 4: A Paper Manufacturing Process Using the Pulp of this Invention

The capability of the pulp of the present invention was evaluated in a tissue pilot machine.

The preparation of the slurry was carried out in batch, where 4.2 tons of slurry were prepared.

Figure 8:
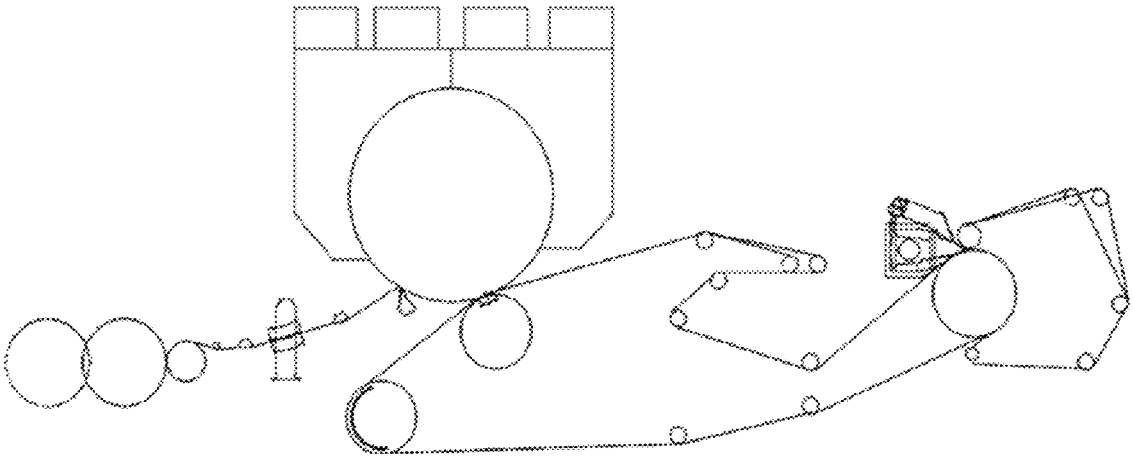
FIG. 8—shows the pilot paper production machine.

After preparation, the slurry was sent for testing in a commercially-available tissue paper machine, as shown in FIG. 8.

As a result, it was observed that the results of the physical strength on paper reproduced the gains in physical strength that were observed in the pulp of the present invention. Specifically, the tensile index increased over 50%, as shown in FIG. 7.

These improved properties—tear index and tensile index—were transferred to the obtained paper, especially tissue paper, and writing and printing paper; moreover, the papermaking process from the pulp thus obtained exhibits productivity gains and resource savings, as it ensures a more efficient drainage/drying, since the degree of resistance to drainage is maintained.

The invention claimed is:

1. Process for producing cellulose pulp from cellulosic feedstock characterized by comprising the steps of:

a) treating the cellulosic feedstock through a chemical or semi-chemical pulping process to produce brown cellulose pulp;

b) bleaching the brown cellulose pulp through a bleaching sequence to obtain a white slurry pulp;

c) adding a starch to the white slurry pulp, wherein the dosage of said starch ranges from 2 to 12 kg/ton of cellulose pulp;

d) adding at least one enzyme to the white slurry pulp which is already doped with the starch to form a doped white slurry pulp, wherein the addition of the at least one enzyme (EZ) takes place according to the following conditions:

i. reaction temperature between 40 and 90° C.;

ii. reaction pH between 3.0 and 9.0;

iii. reaction time between 10 and 300 minutes;

iv. enzyme amount between 10-200 g of the at least one enzyme per ton of cellulose pulp;

e) conveying the doped white slurry pulp to and through a reaction tower before a drying machine; and f) drying the doped white slurry pulp, and denaturing the at least one enzyme, to obtain the cellulose pulp;

wherein the at least one enzyme comprises a cellulase; and wherein the cellulose pulp has a zeta potential from about 5 to about 10 percent less than a pulp prepared in an otherwise identical manner but without the addition of starch and without the addition of enzyme.

2. Process according to claim 1, wherein the cellulosic feedstock is a vegetable fiber.

3. Process according to claim 2, wherein the vegetable fiber is a hardwood fiber.

4. Process according to claim 1, wherein the pulping process is a Kraft process.

5. Process according to claim 1, wherein bleaching comprises using an ECF or TCF bleaching sequence.

6. Process according to claim 1, wherein the addition of the at least one enzyme (EZ) takes place according to the following conditions:

i. reaction temperature between 50 and 80° C.;

ii. reaction pH between 3.5 and 8.0;

iii. reaction time between 30 and 120 minutes;

iv. enzyme amount between 20-100 g of the at least one enzyme per ton of cellulose pulp.

7. Process for producing cellulose pulp from cellulosic feedstock characterized by comprising the steps of:

a) treating the cellulosic feedstock through a chemical or semi-chemical pulping process to produce brown cellulose pulp;

b) bleaching the brown cellulose pulp through a bleaching sequence to obtain a white slurry pulp;

c) adding at least one enzyme to the white slurry pulp, wherein the addition of the at least one enzyme (EZ) takes place according to the following conditions:

i. reaction temperature between 40 and 90° C.;

ii. reaction pH between 3.0 and 9.0;

iii. reaction time between 10 and 300 minutes;

iv. enzyme amount between 10-200 g of the at least one enzyme per ton of cellulose pulp;

d) adding a starch to the white slurry pulp already doped with the at least one enzyme to form a doped white slurry pulp, wherein the dosage of said starch ranges from 2 to 12 kg/ton of cellulose pulp;

e) conveying the doped white slurry pulp to and through a reaction tower before a drying machine; and f) drying the doped white slurry pulp, and denaturing the at least one enzyme, to obtain the cellulose pulp;

wherein the at least one enzyme comprises a cellulase; and wherein the cellulose pulp has a zeta potential from about 5 to about 10 percent less than a pulp prepared in an otherwise identical manner but without the addition of starch and without the addition of enzyme.

8. Process according to claim 7, wherein the cellulosic feedstock comprises a vegetable hardwood fiber.

9. Process according to claim 8, wherein the vegetable fiber is a *eucalyptus* fiber.

10. Process according to claim 7 wherein the pulping process is a Kraft process.

11. Process according to claim 7 wherein the addition of the at least one enzyme (EZ) takes place according to the following conditions:

i. reaction temperature between 50 and 80° C.;

ii. reaction pH between 3.5 and 8.0;

iii. reaction time between 30 and 120 minutes;

iv. enzyme amount between 20-100 g of the at least one enzyme per ton of cellulose pulp.

* * * * *